US005284276A

United States Patent [19]

Cater

[11] Patent Number: 5,284,276

[45] Date of Patent: Feb. 8, 1994

[54] PUMP DISPENSER WITH COMBINED INLET AND OUTLET PORTS

[75] Inventor: Miro S. Cater, Newtown, Conn.

[73] Assignee: Bespak PLC, Norfolk, England

[21] Appl. No.: 964,385

[22] Filed: Oct. 21, 1992

[51] Int. Cl.[5] ..... B05B 11/02; B67D 5/42; G01F 11/04; G01F 11/38

[52] U.S. Cl. ..... 222/321; 222/341

[58] Field of Search ..... 222/321, 340, 341, 383, 222/385

[56] References Cited

U.S. PATENT DOCUMENTS

| | | | |
|---|---|---|---|
| 3,640,470 | 2/1972 | Susuki et al. | 222/321 X |
| 4,025,046 | 5/1977 | Boris | 222/321 X |
| 4,117,957 | 10/1978 | Duffey | 222/321 |
| 4,155,489 | 5/1979 | Steiman | 222/321 |
| 4,230,242 | 10/1980 | Meshberg | 222/321 |
| 4,274,560 | 6/1981 | Cater | 222/321 |
| 4,958,752 | 9/1990 | Maerte et al. | 222/321 |
| 5,020,696 | 6/1991 | Cater | 222/321 |
| 5,038,965 | 8/1991 | Cater | 222/321 X |
| 5,046,644 | 9/1991 | Cater | 222/321 |

FOREIGN PATENT DOCUMENTS

| | | | |
|---|---|---|---|
| 0289855 | 11/1988 | European Pat. Off. | 222/321 |

*Primary Examiner*—Kevin P. Shaver

[57] ABSTRACT

A pump dispenser has a body consisting of two hollow cylinders of dissimilar diameters, the diameters of the two cylinders defining an outer boundary of a pump chamber. A piston defines the inner boundary of the pump chamber. The piston also defines a slidable seal with both body diameters and is provided with an aperture which can function as an outlet port on a downstroke and an inlet port port on an upstroke. A stem cooperates with the piston to form a discharge path which can be opened or closed and also cooperates with the aperture to define the ports. The stem is biased to close the discharge port when the dispenser is in rest position.

8 Claims, 2 Drawing Sheets

PUMP DISPENSER WITH COMBINED INLET AND OUTLET PORTS

BACKGROUND OF THE INVENTION

Pump dispensers are manually operated devices typically disposed on the top of a container of fluid for dispensing the fluid in a desired form from a dispenser nozzle. Dispensers of this type employ a cylindrical body structure, at least one piston and separate inlet and outlet ports individually controlled by separate means for opening and closing them.

The present invention is directed toward a new type of pump dispenser which employs combined inlet and outlet ports and a single means for opening and closing these ports in suitable sequence. This dispenser is characterized by a simplified structure having fewer and less complicated components and manufacturable at significantly reduced cost. This dispenser also has other advantages as described in more detail below.

SUMMARY OF THE INVENTION

Accordingly, it is an object of the present invention to provide a new and improved pump dispenser having combined inlet and outlet ports and a single means for opening and closing these ports.

Another object is to provide a new and improved pump dispenser of the character indicated wherein an aperture functions as an outlet port during a downstroke and as an inlet port during an upstroke.

Another object is to provide a new and improved pump dispenser of the character indicated which employs a minimal number of components.

Yet another object is to provide a new and improved pump dispenser of the character indicated which can be manufactured easily and inexpensively.

Still another object is to provide a new and improved pump dispenser of the character indicated which utilizes seals which never separate, but which are always in sliding engagement, thereby providing a self cleaning, wiping action.

These and other objects and advantages of the invention will either be explained or will become apparent hereinafter.

In accordance with the principles of this invention, the new type of pump dispenser employs a body having integral upper and lower vertical hollow cylinders. The diameter of the upper cylinder is larger than the diameter of the lower cylinder. The upper cylinder has a first central opening in its lower end communicating with the lower cylinder.

A piston is slidable in said body. The piston has an upper vertical hollow cylindrical section open at opposite ends, a first extension connected to the outer surface of the lower end of the upper section and a lower and smaller extension having upper and lower ends, the lower end being open, and an aperture located in the second extension between its ends.

The first extension is always in peripheral sealing engagement with the inner surface of the upper cylinder. The outer surface of the second extension is always in peripheral sealing engagement with the inner surface of the lower cylinder.

A vertical stem is slidable within and extends through the upper section of the piston. The stem and the upper section of the piston are spaced apart to define a vertical discharge path therebetween. The stem has an enlarged head which is always in slidable peripheral sealing engagement with the inner surface of the second extension of the piston.

Means cooperating with the stem normally biases the head into a rest position at which the head closes the discharge path and is disposed above the aperture.

In use, the body is connected to a container of fluid in such manner that fluid in the container can be drawn upward into the body via an opening in the lower end of the lower cylinder. The structure is primed with fluid which is stored in the upper cylinder. This is the rest position.

When an actuator coupled to the piston and stem is manually depressed, a downstroke is initiated. The downstroke produces a downward movement first of the stem relative to the piston and then to both piston and stem. The initial movement of the stem moves the head away from the piston and opens the discharge path. This movement at the same time moves the head into alignment with the aperture and closes it. The additional downward movement moves the head below the aperture which is then opened and functions as an outlet port. The fluid stored in the upper cylinder is discharged through the aperture, the discharge path and a discharge nozzle in the actuator. This discharge continues until the end of the downstroke.

Removal of the manual pressure on the actuator initiates an upstroke, with the stem first moving upward relative to the piston to cause the head to close the discharge path. The aperture then functions as an inlet port, with fluid being drawn upward into the lower cylinder and passing from the lower cylinder through the aperture into the upper cylinder. The actuation cycle is completed once the stem and piston have returned to their original positions and the head is returned to rest position.

Consequently, the dispenser utilizes an aperture to act as an outlet port during a downstroke and to act as an inlet port during an upstroke. The seals formed by the sliding engagement of the first extension and the inner surface of the upper cylinder, the sliding engagement of the second extension and the inner surface of the lower cylinder, and the sliding engagement of the head with the inner surface of the second extension are always in sliding contact which provide a self cleaning, wiping action.

It will be apparent to those skilled in the art that the basic pump dispenser disclosed herein is constructed of only four parts: a body consisting of two cylinders of dissimilar diameters, the diameters of the two cylinders defining an outer boundary of a pump chamber; a piston which defines the inner boundary of the pump chamber, forming a slidable seal with both body diameters and provided with an aperture which can function as an inlet port and an outlet port; a stem which cooperates with the piston to form a discharge path which can be opened or closed and cooperates with the aperture to define an outlet port during a downstroke and an inlet port during an upstroke; and biasing means to place the head in rest position.

DETAILED DESCRIPTION OF PREFERRED EMBODIMENTS

Figure 1:
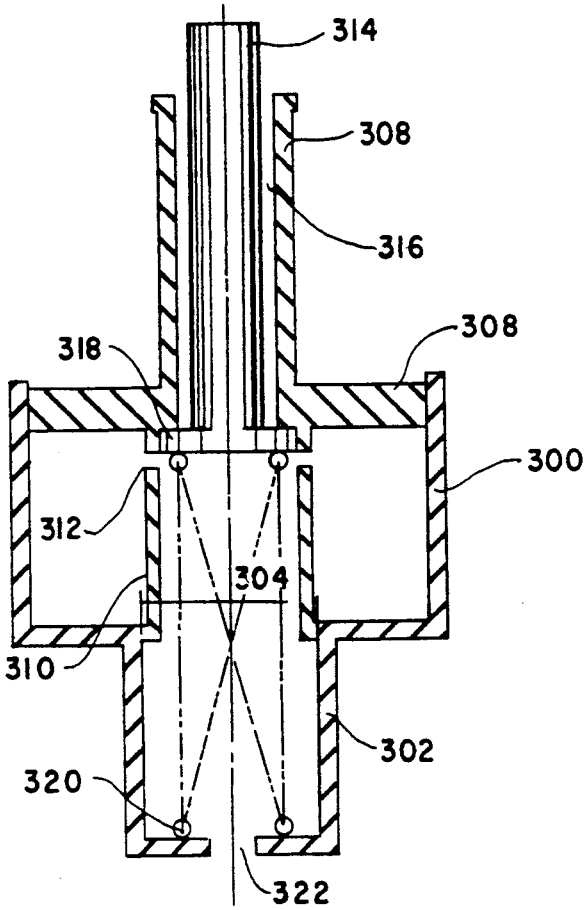
FIG. 1 is a simplified diagramatic cross sectional view of the invention in rest position.
Figure 2:
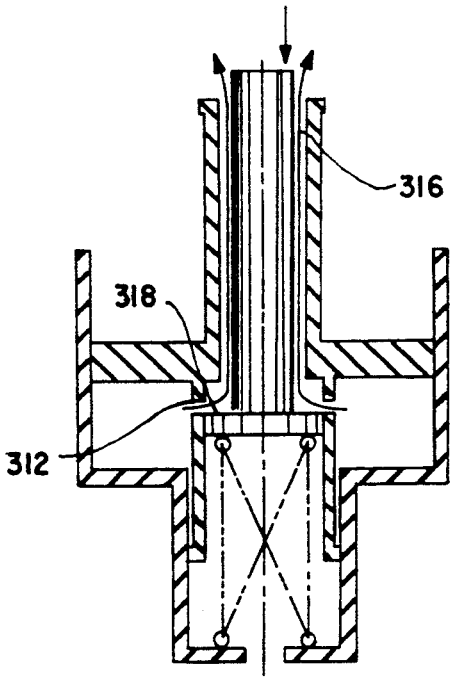
FIG. 2 is a view similar to FIG. 1, illustrating the discharge action.
Figure 3:
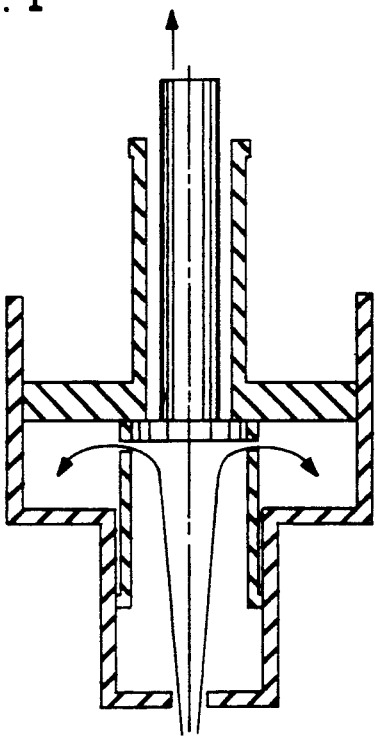
FIG. 3 is a view similar to FIG. 2, illustrating the filling action.

Referring first to FIGS. 1-3, a body has integral upper and lower vertical hollow cylinders 300 and 302 with a common vertical axis. The diameter of the upper cylinder 300 is larger than the diameter of the lower cylinder 302. The upper cylinder has a first central opening 304 in its lower end communicating with the lower cylinder.

A piston is slidable in said body. The piston has an upper vertical hollow cylindrical section open at opposite ends 306, a first extension 308 centered on the outer surface of the lower end of the upper section and a lower and smaller extension 310 with a upper and lower ends, the lower end being open, and an aperture 312 located between the ends of the second extension. As shown, the aperture employs at least one opening. Typically, the aperture employs two or more equidistantly spaced openings which are horizontally aligned.

The first extension 308 is always in peripheral sealing engagement with the inner surface of the upper cylinder 300. The outer surface of the second extension 310 is always in peripheral sealing engagement with the inner surface of the lower cylinder 302.

A vertical stem 314 is slidable within and extends through the upper section 306 of the piston. The stem 314 and the upper section 306 of the piston are spaced apart to define a vertical discharge path 316 therebetween. The stem has an enlarged head 318 which is always in slidable peripheral sealing engagement with the inner surface of the second extension of the piston. The head has a rest position at which the head is disposed above the aperture and at the same time engages the lower end of the upper section 306 to close the discharge path.

Means cooperating with the stem normally biases the head into the rest position. This means can be a spring 320 disposed between the lower end of the lower cylinder and the head.

In use, the body is connected to a container of fluid [not shown] in such manner that fluid in the container can be drawn upward into the body via an opening 322 in the lower end of the lower cylinder. The structure is primed with fluid being stored in the upper cylinder.

Figure 4:
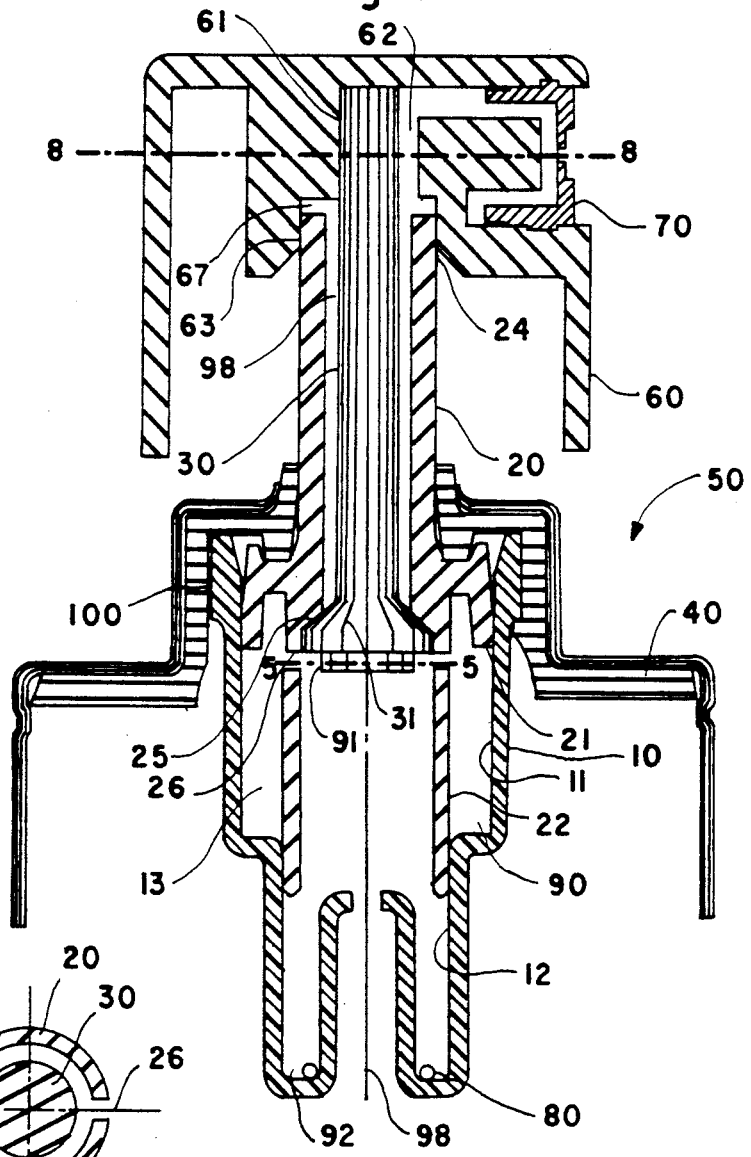
FIG. 4 is a cross sectional view of a preferred embodiment of the invention shown at rest.

When an actuator [of the type shown, for example in FIG. 4] coupled to the piston and stem is manually depressed, a downstroke is initiated. The downstroke produces a downward movement first of the stem relative to the piston and then to both piston and stem. The initial movement of the stem moves the head away from the piston and opens the discharge path. This movement at the same time moves the head into alignment with the aperture and closes it. The additional downward movement moves the head below the aperture which is then opened and functions as an outlet port. The fluid stored in the upper cylinder is discharged through the aperture, the discharge path and a discharge nozzle in the actuator. This discharge continues until the end of the downstroke.

Removal of the manual pressure on the actuator initiates an upstroke, with the stem first moving upward relative to the piston to cause the head to close the discharge path. The aperture then functions as an inlet port, with fluid being drawn upward into the lower cylinder and passing from the lower cylinder through the aperture into the upper cylinder. The actuation cycle is completed once the stem and piston have returned to their original positions and the head is returned to rest position.

Consequently, the dispenser utilizes the same aperture to act as an outlet port during a downstroke and to act as an inlet port during an upstroke. The seals formed by the sliding engagement of the first extension and the inner surface of the upper cylinder, the sliding engagement of the second extension and the inner surface of the lower cylinder, and the sliding engagement of the head with the inner surface of the second extension provide a self cleaning, wiping action.

Figure 6:
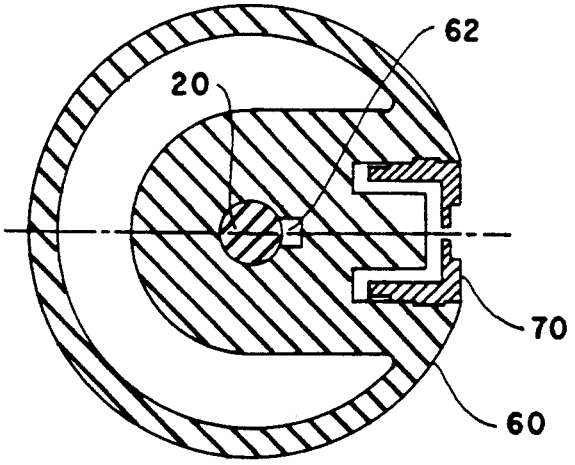
FIG. 6 is a cross sectional view taken along line 6—6 in FIG. 4.
Figure 5:
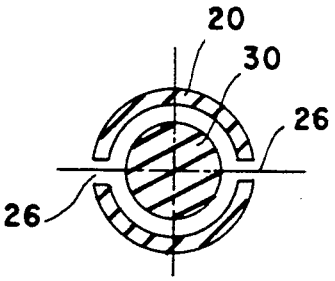
FIG. 5 is a cross sectional view taken along line 5—5 in FIG. 4.

Referring now to FIGS. 4, 5 and 6, the dispenser utilizes a hollow upper cylinder 11 having a first diameter and an integral hollow lower cylinder 12 having a second and smaller diameter.

A piston has a vertical hollow upper section 20, a first extension 21 having a large sealing periphery which is in continuous sealing engagement with the inner surface of cylinder 11 and a second smaller extension 22. The inner surface of the lower end of section 20 has the shape of an inwardly extending recess contour shown at 25. Extension 22 takes the shape of a vertical hollow cylinder having an open upper and lower ends, the upper end being integral with the lower end of section 20. The lower end of extension 22 has a sealing periphery which is in continuous sealing engagement with the inner surface of cylinder 12. Extension 22 has two openings 26 which are horizontally aligned and are equidistantly spaced and define an aperture.

A stem 30 is slidably disposed within the piston, being spaced inwardly from section 20 to define a discharge passage 96 therebetween. The stem has at its lower end an enlarged solid head 31 having a surface conforming to that shown at 25. The bottom surface of head 31 has a peripheral annular flat surface 94 with a lower centrally extending flat disc. Head 31 has a vertical outer surface 27 which has a sealing periphery always in continuous sealing engagement with the inner surface of extension 22.

An annular region 90 is formed between the upper end of the lower cylinder and the lower end of the upper cylinder. Region 90 can be used as a lower stop for the movement of the extension 21. The lower end of cylinder 12 can have an inwardly and upwardly extending section with an inlet opening 98. This section also can depend downwardly from the cylinder if desired. In either event, an annular region 92 is formed between the section and the lower end of the cylinder.

A spring 80 is disposed in the dispenser, with its lower end engaging region 92 and its upper end bearing against annular region 94.

An actuator 60 is rigidly secured to the top end of the stem as shown at 61. A passage 62 is formed between an upper portion of the stem and the actuator to form a discharge region connected to discharge path 96. Passage 62 is connected to discharge nozzle 70. A gap 67 is formed between the upper end of region 30 of the piston and a recess 63 in the actuator. The upper end seals against the recess 63 and remains in sliding peripheral engagement therewith.

The upper end of cylinder 11 is mounted in a collar 40 which is surrounded by a mounting means or cup 50.

Cup 50 is secured to the neck of a fluid container [not shown] and in conventional manner an air intake path 100 is formed therebetween.

In the rest position, the head engages surface 25 and closes the discharge path. In this position, the head is disposed at least partially above the aperture.

When downward pressure is applied to the actuator, the actuator and stem travel downwards against the force of the spring while the frictional forces between the cylinders and the extensions maintain the piston motionless. The depth of the gap 67 decreases progressively. The sealing surfaces 25 and 31 begin to separate as the stem moves downwardly relative to the piston while the head moves into alignment with the aperture and closes it. As the actuation continues, the gap is reduced to zero, the piston is forced downward by the actuator, the discharge path is opened, and the head moves below the aperture and opens it. The fluid is forced out of the upper cylinder as the fluid volume is reduced because of the downward movement of the piston and is further forced through the aperture, the discharge path and the discharge region for discharge through the nozzle.

Once the downward pressure is removed from the actuator, the spring forces the stem and actuator upwards. The frictional forces between the extensions and the cylinders maintain the piston initially motionless until the head engages surface 25 and closes the discharge path. The piston and stem move upwards, producing a suction which draws the fluid upward in the lower cylinder, through the aperture and into the upper cylinder. This process continues until the piston and stem are returned to the rest position and the head is then returned to its rest position.

The biasing means need not be a spring as shown as long as it is incorporated somewhere in the structure to force the stem against the piston and close the discharge path in the rest position.

While the invention has been described with particular reference to the drawings, the protection solicited is to be limited only by the terms of the claims which follow.

What is claimed is:

1. A pump dispenser comprising:

a body having integral upper and lower vertical hollow cylinders, the diameter of the upper cylinder being larger than the diameter of the lower cylinder, the upper cylinder having a first opening in its lower end communicating with the lower cylinder;

a piston slidably in said body, the piston having an upper vertical hollow cylindrical section open at opposite ends, a first extension secured to the outer surface of the lower end of the upper section and a lower and smaller hollow second extension having upper and lower ends, the lower end being open, and an aperture located between the ends of the second extension, the first extension being in sealing engagement with the inner surface of the upper cylinder, the second section being in sealing engagement with the inner surface of the lower cylinder; and a vertical stem slidable within and extending through the upper section of the piston and spaced therefrom to define a vertical discharge path therebetween, the stem having an enlarged head at its lower end which is in slidable sealing engagement with the inner surface of second extension, the head having a rest position at which it closes the discharge path and is disposed above the aperture.

2. The dispenser of claim 1 further including means normally biasing the head into the rest position.

3. The dispenser of claim 2 further including an actuator secured to the upper end of the stem and engagable through a gap with the upper end of the upper section of the piston.

4. The dispenser of claim 3 wherein the actuator when pressed downwardly produces a downstroke with downward movements of the piston and stem opening the discharge path and moving the head below the aperture, causing fluid previously stored in the upper cylinder to be discharged through the aperture and the discharge path, the actuator, when the pressure is released, initiating an upstroke with upward movements of the piston and stem responding to the normal bias applied to the head closing the discharge path, causing fluid to be drawn upward through the second opening into the lower cylinder and passing from the lower cylinder through the aperture into the upper cylinder, the upstroke being terminated when the head is returned to rest position.

5. A pump dispenser comprising:

a body having integral upper and lower vertical hollow cylinders, the diameter of the upper cylinder being larger than the diameter of the lower cylinder, the upper cyinder having a first opening in its lower end communicating with the lower cylinder, the lower cylinder having a second opening in its lower end through which fluid to be dispensed can enter;

a piston slidable in said body, the piston having an hollow vertical cylindrical section open at opposite ends, a first extension secured to the outer surface of the lower end of the upper section and a second lower and smaller hollow cylindrical second extension having upper and lower ends and open at its lower end, the second extension having an aperture positioned between its ends, the first extension being in peripheral sealing engagement with the inner surface of the upper cylinder, the second extension being in peripheral sealing engagement with the inner surface of the lower cylinder;

a vertical stem slidable within and extending through the upper section of the piston and spaced therefrom to define a vertical discharge path therebetween, the stem having an enlarged head at its lower end which is in slidable peripheral sealing engagement with the inner surface of the second extension; and means disposed in said body and normally biasing the head into a rest position disposed above the aperture and engaging the lower end of the upper section to close the discharge path.

6. A pump dispenser comprising:

a body having integral upper and lower vertical hollow cylinders, the diameter of the upper cylinder being larger than the diameter of the lower cylinder, the upper cylinder having a first opening in its lower end communicating with the lower cylinder;

a piston slidable in said body, the piston having an upper vertical hollow cylindrical section open at opposite ends, a first extension secured to the outer surface of the lower end of the upper section and a lower and smaller hollow second extension having upper and lower ends, the lower end being open, and an aperture located between the ends of the second extension, the first extension defining an upper seal peripherally engaging the inner surface of the upper cylinder, the second section defining a lower seal peripherally engaging the inner surface of the lower cylinder; and a vertical stem slidable within and extending through the upper section of the piston and spaced therefrom to define a vertical discharge path therebetween, the stem having means at its lower end which is in slidable sealing engagement with the lower seal, the means having a rest position at which it engages the piston and closes the aperture.

7. The dispenser of claim 6 wherein the upper seal is slidably confined to the upper cylinder and the lower seal is slidably movable in both cylinders.

8. The dispenser of claim 7 wherein the means is in slidable sealing engagement with the lower seal.

* * * * *